US012486084B2

(12) United States Patent
Guo

(10) Patent No.: US 12,486,084 B2
(45) Date of Patent: Dec. 2, 2025

(54) PACKAGING COVER AND PACKAGING CONTAINER

(71) Applicant: Hangzhou Yici Chengpin Technology Co., Ltd., Hangzhou (CN)

(72) Inventor: Xukai Guo, Yongan (CN)

(73) Assignee: Hangzhou Yici Chengpin Technology Co., Ltd., Hangzhou (CN)

( * ) Notice: Subject to any disclaimer, the term of this patent is extended or adjusted under 35 U.S.C. 154(b) by 170 days.

(21) Appl. No.: 18/229,194

(22) Filed: Aug. 2, 2023

(65) Prior Publication Data

US 2025/0042623 A1 Feb. 6, 2025

(51) Int. Cl.

| | |
|---|---|
| ***B65D 43/02*** | (2006.01) |
| ***B65D 77/20*** | (2006.01) |
| ***B65D 83/08*** | (2006.01) |

(52) U.S. Cl.

CPC ..... *B65D 43/0225* (2013.01); *B65D 77/20* (2013.01); *B65D 83/0817* (2013.01); *B65D 2251/06* (2013.01); *B65D 2543/00351* (2013.01)

(58) Field of Classification Search

CPC ..... B65D 43/0025; B65D 83/0805; B65D 77/20; B65D 77/30; B65D 83/0817; B65D 2251/06; B65D 2313/04; B65D 2543/00351; B65D 67/02

USPC ..... 220/230, 200, 259.3; 221/63, 46, 79; 206/494, 210, 233

See application file for complete search history.

(56) References Cited

U.S. PATENT DOCUMENTS

| | | | | |
|---|---|---|---|---|
| 3,203,747 A * | 8/1965 | Vercellotti | A45D 44/16 312/211 |
| 3,795,355 A * | 3/1974 | Gerstein | B65D 83/0805 225/106 |
| 4,185,754 A * | 1/1980 | Julius | B65D 83/0805 229/125.09 |
| 4,303,751 A * | 12/1981 | Campbell | G03C 8/34 206/524.5 |
| 4,362,698 A * | 12/1982 | Boosalis | B01L 3/50825 220/359.3 |
| 5,542,567 A * | 8/1996 | Julius | B65D 83/0805 221/63 |

(Continued)

*Primary Examiner* — Steven A. Reynolds
*Assistant Examiner* — Prince Pal
(74) *Attorney, Agent, or Firm* — Hawaii Patent Services; Nathaniel K. Fedde; Kenton N. Fedde

(57) ABSTRACT

A packaging cover and a packaging container are provided, which relate to the technical field of supplies. The packaging container comprises a container main body which is provided with an opening and a packaging cover which comprises a cover ring having an opening and a cover body covering the opening; wherein the cover ring and the container main body are detachably connected, the opening of the cover ring is communicated with the opening of the container main body, and the cover body can open or close the opening of the cover ring and the opening of the container main body under operations of a user. The above technical solution has the following advantages: the packaging cover can be installed on the packaging container according to customer requirements, and it is not easy to lose the packaging cover after the user opens the packaging container, and when the packaging cover is closed, it can prevent dust from entering the packaging container.

15 Claims, 13 Drawing Sheets

(56) References Cited

U.S. PATENT DOCUMENTS 5,681,740 A * 10/1997 Messier ..... A01N 1/146 435/284.1
5,704,471 A * 1/1998 Yamada ..... B65D 83/0805 206/812
6,488,176 B2 * 12/2002 Garrant ..... B65D 83/0454 206/703
6,554,156 B1 * 4/2003 Chong ..... A47K 10/3818 221/303
6,585,131 B2 * 7/2003 Huang ..... B65D 83/0805 221/33
6,702,109 B1 * 3/2004 Tabuchi ..... B65D 75/5838 53/133.4
6,766,919 B2 * 7/2004 Huang ..... B65D 83/0805 221/63
6,769,567 B2 * 8/2004 Gauthier ..... H01M 50/216 206/703
7,232,041 B2 * 6/2007 Ferguson ..... H01M 50/216 221/241
7,416,083 B2 * 8/2008 Bando ..... A47K 10/421 206/812
7,422,782 B2 * 9/2008 Haedt ..... B32B 7/12 428/476.3
7,461,760 B2 * 12/2008 Ferguson ..... H01M 50/216 221/241
7,607,430 B2 * 10/2009 Davis ..... H01F 7/0263 128/200.11
7,665,629 B2 * 2/2010 Julius ..... B65D 75/5877 221/302
8,206,003 B1 * 6/2012 LaBarge ..... F21V 23/0464 362/186
8,317,048 B2 * 11/2012 Hajichristou ..... B65D 43/0225 220/230
8,495,803 B2 * 7/2013 Fiedler ..... A45C 13/1069 70/160
8,851,534 B2 * 10/2014 Fiedler ..... H01F 7/0263 220/230
9,016,501 B2 * 4/2015 Hara ..... H01L 21/67742 220/230
9,125,532 B2 * 9/2015 Bechyne ..... A47K 10/421
9,279,527 B2 * 3/2016 Davis ..... B65D 43/0202
9,327,892 B2 * 5/2016 Rubo ..... B65D 75/5838
9,334,094 B2 * 5/2016 Zacard ..... B65D 73/0057
9,789,998 B2 * 10/2017 Cukman ..... B65D 23/14
10,470,621 B1 * 11/2019 Moore ..... B65D 1/32
10,472,141 B2 * 11/2019 Wang ..... B65D 51/22
10,518,942 B2 * 12/2019 Seibert ..... B65D 43/24
10,542,854 B2 * 1/2020 Harris ..... A47K 10/3818
10,766,671 B2 * 9/2020 Mooney ..... B65D 43/162
10,806,310 B2 * 10/2020 Mann ..... B65D 83/08
11,701,302 B1 * 7/2023 Staggs ..... A61K 31/40 206/536
11,723,448 B2 * 8/2023 Gaytan ..... A47K 10/38 224/196
11,980,258 B2 * 5/2024 Grabowski ..... A44B 17/0005
12,029,837 B2 * 7/2024 Patton ..... A61L 9/122
12,312,130 B2 * 5/2025 Cahalan ..... B65D 83/0805
2002/0030062 A1 * 3/2002 Garrant ..... B65D 83/0454 221/87
2002/0060224 A1 * 5/2002 Garrant ..... B65D 83/0409 221/79
2005/0011906 A1 * 1/2005 Buck ..... B65D 75/5877 221/64
2005/0177985 A1 * 8/2005 Sjoquist ..... A41F 1/002 24/104
2005/0189367 A1 * 9/2005 Chasid ..... B65D 83/0805 221/63
2006/0060598 A1 * 3/2006 Bando ..... B65D 83/0805 221/48
2006/0283750 A1 * 12/2006 Villars ..... B65D 83/0894 206/233
2007/0284386 A1 * 12/2007 Shoemaker ..... A45C 11/008 221/63
2010/0032403 A1 * 2/2010 Hajichristou ..... B65D 50/061 215/337
2010/0287741 A1 * 11/2010 Fiedler ..... A45C 13/1069 24/303
2011/0079526 A1 * 4/2011 Blakeman ..... B65D 83/0805 206/457
2011/0132907 A1 * 6/2011 Hajichristou ..... B65D 43/0225 215/337
2011/0240514 A1 * 10/2011 Bandoh ..... B65D 43/16 206/494
2011/0266195 A1 * 11/2011 Ogando ..... B65D 5/4208 206/750
2011/0315566 A1 * 12/2011 Boynton ..... A45C 11/16 206/459.5
2011/0315567 A1 * 12/2011 Boynton ..... B65D 51/245 206/6.1
2012/0097697 A1 * 4/2012 Gehring ..... B65D 75/5838 221/46
2012/0199640 A1 * 8/2012 Thorne ..... B65D 5/425 229/223
2013/0056486 A1 * 3/2013 Latta ..... B32B 7/12 220/359.3
2013/0104599 A1 * 5/2013 Beldiman ..... A44C 5/003 63/1.14
2014/0048438 A1 * 2/2014 Woo ..... B32B 1/00 428/41.9
2014/0305828 A1 * 10/2014 Salvo ..... G08B 13/126 340/568.1
2015/0008238 A1 * 1/2015 Yamada ..... B65D 83/0805 221/63
2015/0053712 A1 * 2/2015 Laflin ..... A47K 10/3818 221/45
2015/0197366 A1 * 7/2015 Chapin ..... B65D 17/4012 220/254.1
2015/0216285 A1 * 8/2015 Grainger ..... A44C 9/0069 206/581
2015/0216378 A1 * 8/2015 Fulscher ..... A47K 10/42 221/45
2015/0217897 A1 * 8/2015 Fitzwater ..... B65D 33/02 493/94
2016/0113450 A1 * 4/2016 Yamada ..... B65D 75/5894 221/53
2017/0096265 A1 * 4/2017 Kieffer ..... B65D 43/163
2017/0129660 A1 * 5/2017 Hsu ..... B65D 51/18
2018/0051844 A1 * 2/2018 Yeater ..... F16L 57/005
2019/0161252 A1 * 5/2019 Wang ..... B65D 43/164
2020/0085249 A1 * 3/2020 Sutterer ..... A47K 10/424
2021/0292051 A1 * 9/2021 Andrews ..... A45C 13/1069
2024/0100209 A1 * 3/2024 Wang ..... A61L 2/10
2024/0150090 A1 * 5/2024 Adams ..... B65D 47/265
2024/0217710 A1 * 7/2024 Cheng ..... B65D 43/0231
2025/0025000 A1 * 1/2025 Park ..... B65D 83/0805
2025/0042623 A1 * 2/2025 Guo ..... B65D 83/0817

* cited by examiner

PACKAGING COVER AND PACKAGING CONTAINER

TECHNICAL FIELD

The utility model relates to the technical field of supplies, in particular to a packaging cover and a packaging container.

BACKGROUND

In daily life, people like to use packaging containers with openings to contain some small items, such as jewelry, garment buttons, granular spices or wet tissue boxes, etc. Some of these packaging containers have packaging covers, and some do not have packaging covers. Dust easily enters the packaging container without the packaging cover from the exposed opening to pollute the items in the packaging container. Some packaging containers with covers are threaded, and the user easily loses the packaging cover after opening the packaging container, resulting in dust entering the packaging container from the opening and contaminating the items in the packaging container. Therefore, it is necessary to design a packaging cover that can be fixed to the opening of the packaging container and is not easily lost.

SUMMARY

Aiming at the defects and deficiencies of the prior art, the utility model provides a packaging container, which has the following advantages: the packaging cover can be installed on the container main body according to customer requirements, is not easily lost after the user opens the packaging container, and can prevent dust from entering the packaging container when being closed.

In order to achieve the above purpose, the technical solution adopted by the utility model is that, the packaging container comprises a container main body which is provided with an opening and a packaging cover which comprises a cover ring having an opening and a cover body covering the opening; wherein the cover ring and the container main body are detachably connected, the opening of the cover ring is communicated with the opening of the container main body, and the cover body can open or close the opening of the cover ring and the opening of the container main body under the operation of a user.

Exemplarily, the detachable connection of the cover ring and the container main body comprises at least one of the following methods:

A) the cover ring and the container main body are detachably connected by bonding;

B) the cover ring and the container main body are detachably connected by clamping;

C) the cover ring and the container main body are detachably connected by magnetic attraction.

Exemplarily, the container main body comprises an adhesive film which surrounds the opening of the container main body, and the adhesive film is bonded to a surface of the cover ring away from the cover body to realize the connection of the cover ring and the container main body.

Exemplarily, the adhesive film comprises a first adhesive layer and a second adhesive layer that are laminated, and a thickness of the first adhesive layer is greater than that of the second adhesive layer.

Exemplarily, the adhesive film further comprises an interlayer arranged between the first adhesive layer and the second adhesive layer, and material of the interlayer is different from that of the first adhesive layer and the second adhesive layer.

Exemplarily, the adhesive film is provided with a plurality of vias/openings distributed at intervals, and the vias/openings are used for avoiding functional devices on the surface of the cover ring away from the cover body.

Exemplarily, the cover body is rotatably installed on the cover ring, the packaging cover further comprises a first magnetic part arranged on the cover ring and a second magnetic part arranged on the cover body, and the first magnetic part and the second magnetic part can be attracted or separated to open or close the opening.

When the cover body and the cover ring fully coincide the first magnetic part comprise a first magnet and at least one second magnet. The second magnetic part is one in number, and when the cover body and the cover ring fully coincide, the second magnetic part and the first magnet coincide.

Exemplarily, the height of the first magnet is greater than that of the second magnet. When the cover body and the cover ring fully coincide, a distance between the second magnet and the cover body is greater than that between the first magnet and the cover body.

Exemplarily, clamping slots are spaced apart on one side of the cover ring away from the cover body, and buckle parts are arranged at an edge of the opening of the container main body. The buckle parts are inserted into the clamping slot to connect the container main body and the packaging cover with buckle.

Exemplarily, a decorative part is protruded on one side of the cover body away from the cover ring; the cover body comprises a decorative cover and a cover main body arranged successively from top to bottom, the decorative part is located on the top of the decorative cover, the cover main body is used to cover the opening, a plurality of plugging columns are arranged at the bottom of the decorative cover, and a plurality of plugging slots fixed with the plugging columns one by one in a plugging way are arranged at the top of the cover main body.

In order to achieve the above purpose, the utility model also adopts the following technical solution: A packaging cover, comprising a cover ring having an opening, wherein the cover body can open or close the opening (12) under operations of a user;

The packaging cover further comprises a first magnetic part arranged on the cover ring and a second magnetic part arranged on the cover body, and the first magnetic part and the second magnetic part can be attracted or separated to open or close the opening.

Exemplarily, the cover body is rotatably assembled on the cover ring through a rotating shaft, and the first magnetic part and the rotating shaft are spaced apart and arranged oppositely with respect to the opening.

Exemplarily, the first magnetic part comprises a first magnet and at least one second magnet, the second magnetic part is one in number, and when the cover body and the cover ring fully coincide, the second magnetic part and the first magnet coincide.

Exemplarily, the at least one second magnet is two in number, the two second magnets are respectively arranged on two sides of the first magnet, and the spacing between the two second magnets and the first magnet is equal; the first magnet and the second magnet are embedded in the cover ring, and one side of the first magnet (51) and one side the second magnet (52) away from the cover body (2) are exposed from and flush with one side of the cover ring (1) away from the cover body (2).

Exemplarily, the height of the first magnet is greater than that of the second magnet. When the cover body and the cover ring fully coincide, a distance between the second magnet and the cover body is greater than that between the first magnet and the cover body.

Exemplarily, at least two clamping slots are spaced apart on one side of the cover ring away from the cover body.

Exemplarily, a decorative part is protruded on one side of the cover body away from the cover ring; the cover body comprises a decorative cover and a cover main body arranged successively from top to bottom, the decorative part is located on the top of the decorative cover, the cover main body is used to cover the opening, a plurality of plugging columns are arranged at the bottom of the decorative cover, and a plurality of plugging slots fixed with the plugging columns one by one in a plugging way are arranged at the top of the cover main body.

After adopting the above-mentioned technical solution, the beneficial effects of the utility model are as follows.

On the one hand, the cover ring and the cover body of the packaging cover of the embodiments of the present application can be rotated relative to each other to realize opening or closing of the opening of the cover ring. Specifically, when the first magnetic part and the second magnetic part attract each other, the cover body can close the opening of the cover ring, and when the first magnetic part and the second magnetic part are separated, the cover body can open the opening of the cover ring.

On the other hand, the packaging cover of the packaging container and the container main body are detachably connected, and when the packaging cover is installed on the packaging container, the cover body can rotate relative to the cover ring to open the opening of the cover ring and the opening of the container main body at the same time and to close the opening of the cover ring and the opening of the container main body at the same time. Furthermore, in the embodiments of the present application, the first magnetic part and the second magnetic part are connected by magnetic attraction, and the connection method is simple.

During use, the user can open or close the opening of the container main body connected with the cover ring by toggling the cover body horizontally to rotate relative to the cover ring. When the opening of the cover ring is open, the user can fill the container main body or take the items from the container main body. When the cover ring and the cover body coincide, the opening of the container main body can be closed to prevent contaminants such as external dust from entering the container main body and contaminating the items inside the container main body.

BRIEF DESCRIPTION OF DRAWINGS

To explain the technical proposal of the embodiments of the utility model more clearly or the prior art, the drawings required for the description of the embodiments or the prior art are briefly introduced. It is obvious that the drawings below are only for some embodiments of the utility model. The ordinary technicians in the field can also obtain other drawings from these drawings without creative labor.

DESCRIPTION OF REFERENCE SIGNS IN THE DRAWINGS

Figure 1:
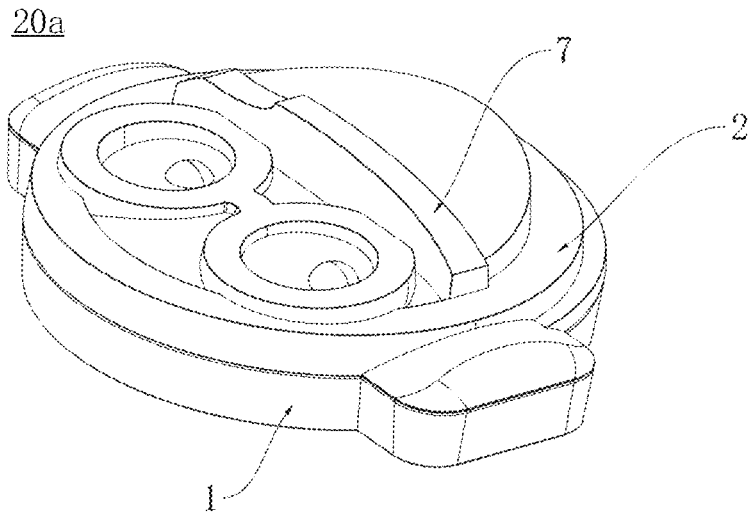
FIG. 1 is the structural diagram of the packaging cover.
Figure 2:
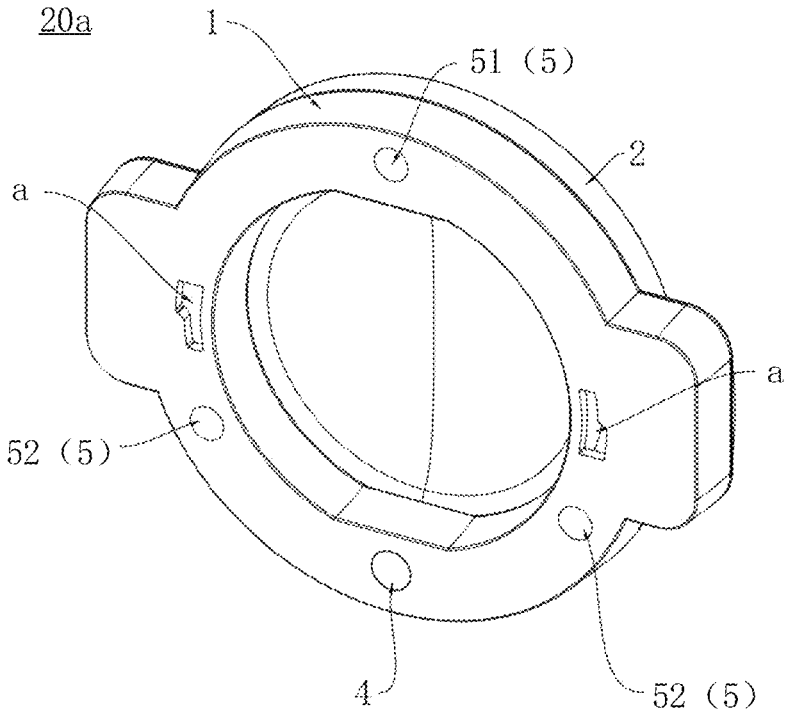
FIG. 2 is the structural diagram of the packaging cover in another direction.

20*a*. Packaging cover; 1. Cover ring; 12. Opening; 13. Annular groove; 14. Shaft hole; 16. straight segment; 18. arc segment; d. Reinforcing column; e. Reinforcing column; f. Mounting groove; 2. Cover body; 4. Rotating shaft; 5. First magnetic part; 51. First magnet; 52. Second magnet; a. Clamping slot; 6. Second magnetic part; 7. Decorative part; 22. Decorative cover; 23. Cover main body; 232. Shaft hole; 234. Depression part; 236. Protrusion part; 8. Plugging column; b. Plugging slot; c. Reinforcing column; 9. Reinforcing rib;

20*b*. Packaging cover; 1*b*. Cover ring; 2*b*. Cover body; 7. Decorative part;

100*a*. Packaging container; 10*a*. Container main body; 101*a*. Adhesive film; 102*a*. Opening; 103*a*. Storage space; 1011*a*. First adhesive layer; 1012*a*. Second adhesive layer; 1013*a*. Interlayer; 104*a*. Via/opening;

100*b*. Packaging container; 10*b*. container main body; 11*b*. Elastic part; 101*b*. Buckle part; 102*b*. Opening; 103*b*. Storage space.

DETAILED DESCRIPTION OF THE EMBODIMENTS

The present module utility is described in further detail below in conjunction with the accompanying drawings.

The embodiment is only the interpretation of the utility model, but not a limitation to the utility model. The technicians in the field can make modifications without creative contributions to the embodiment as required after reading the specification, and such modifications within the scope of the claims of the utility model are protected by the patent law.

As shown in FIG. 1-FIG. 5, the present embodiment relates to a packaging cover 20*a*, which comprises a cover ring 1 and a cover body 2, and the cover ring 1 has an opening 12 penetrating through the cover ring 1 in the direction of its thickness. The cover body 2 can cover the opening 12. The cover body 2 is rotatably assembled on the cover ring 1, that is, the cover body 2 is connected with the cover ring 1, and the cover body 2 can rotate with respect to the cover ring 1. Exemplarily, the cover body 2 can rotate horizontally with respect to the cover ring 1, such as the cover body 2 can rotate horizontally with respect to the cover ring 1 under the user's operation to open or close the opening 12 of the cover ring 1. It is understood that in other embodiments, the cover body 2 may also rotate vertically with respect to the cover ring 1 to open or close the opening 12 of the cover ring 1.

Exemplarily, the cover body 2 is rotatably assembled on the cover ring 1 through a rotating shaft 4, and the cover body 2 can rotate around the rotating shaft 4 with respect to the cover ring 1. The rotating shaft 4 can penetrate through the cover body 2 and the cover ring 1. Exemplarily, the cover ring 1 is provided with a shaft hole 14, and the cover body 2 is provided with a shaft hole 232, so that the rotating shaft 4 can be installed in the shaft hole 14 of the cover ring 1 and the shaft hole 232 of the cover body 2.

In other optional embodiments, the cover body 2 has a rotating shaft. For example, the rotating shaft and the cover body 2 are integrally arranged, correspondingly, the cover ring 1 is provided with a shaft hole such as a shaft hole 14, and the rotating shaft on the cover body 2 can be installed in the shaft hole of the cover ring 1.

In other optional embodiments, the cover ring 1 has a rotating shaft. For example, the rotating shaft and the cover ring 1 are integrally arranged, correspondingly, the cover body 2 is provided with a shaft hole such as a shaft hole 232, and the rotating shaft on the cover ring 1 can be installed in the shaft hole of the cover body 2.

Exemplarily, the rotation range of the cover body 2 relative to the cover ring 1 can be set according to the actual needs, for example, the rotation range of the cover body 2 relative to the cover ring 1 is 180 degrees, 360 degrees, and other ranges.

Exemplarily, the rotating shaft 4 is a damping shaft fixedly connected with the cover body 2 and the cover ring 1 at both ends respectively. There is a certain friction force between the rotating shaft 4 and the cover body 2 and the cover ring 1, so that the rotating shaft 4 can increase the connection stability between the cover body 2 and the cover ring 1 to a certain extent. Therefore, when the packaging cover 20*a* is inclined or moving, and the user does not toggle the cover body 2, the cover body 2 is prevented from turning due to gravity and opens the opening 12 of the cover ring 1.

In order to increase the connection stability of the cover ring 1 and the rotating shaft 4, in the embodiments of the present application, a reinforcing column d is arranged on one side of the cover ring 1 close to the cover body 2, and the shaft hole 14 penetrates through the reinforcing column d.

Exemplarily, the packaging cover 20*a* further comprises a first magnetic part 5 arranged on the cover ring 1 and a second magnetic part 6 arranged on the cover body 2, and the first magnetic part 5 and the second magnetic part 6 can be attracted or separated to open or close the opening 12 of the cover ring 1. Exemplarily, the first magnetic part 5 comprise a first magnet 51, and the first magnet 51 and the second magnetic part 6 can be attracted or separated. Exemplarily, the number of the first magnet 51 and the number of the second magnetic part 6 are the same, for example, the numbers of the first magnet 51 and the second magnetic parts 6 are both one.

Exemplarily, the second magnetic part 6 may be a metal block or magnetic iron capable of being magnetically fixed with the first magnet 51.

Exemplarily, the first magnet 51 may be a metal block or magnetic iron capable of being magnetically fixed with the first magnet 6.

Exemplarily, at least one of the first magnet 51 and the second magnetic part 6 is a magnetic component, such as a magnetic iron. Exemplarily, the first magnet 51 is a magnetic iron and the second magnetic part 6 is a magnetic iron.

It should be understood that the first magnet 51 and the second magnetic part 6 attract each other, and can also be understood as magnetic attraction or attraction.

When the cover body 2 closes the opening 12 of the cover ring 1, the cover body 2 can fully coincide with the cover ring 1, and the second magnetic part 6 coincides with the first magnet 51. It should be understood that the coincidence of the second magnetic part 6 and the first magnet 51 can be considered as at least partially coincide, and the embodiments of the present application takes the full coincidence of the second magnetic part 6 and the first magnet 51 as an example.

In order to improve the balance of the cover ring 1, and then improve the overall balance of the packaging cover 20*a*, in an optional embodiment of the application, the first magnetic parts 5 such as the first magnet 51 and the rotating shaft 4 are spaced apart with respect to the opening 12 of the cover ring 1, and are arranged approximately opposite to each other.

Exemplarily, the central axis of the first magnet 51 and the central axis of the rotating axis 4 are approximately perpendicular to the cover ring 1.

Exemplarily, the central axis of the first magnet 51 and the central axis of the rotating axis 4 are approximately parallel.

Exemplarily, the plane where the central axis of the first magnet 51 and the central axis of the rotating axis 4 are located can divide the cover ring 1 into two equals. For example, if the central axis of the first magnet 51 and the central axis of the rotating axis 4 are two connection points, and the cover ring 1 is cut in a direction roughly perpendicular to the cover ring 1 into two parts that are symmetrical with respect to the cutting surface.

Exemplarily, the cover ring 1 is generally in a circular structure. The central axis of the first magnet 51 and the central axis of the rotating shaft 4 can be located on an outer diameter of the cover ring 1 together.

The cover ring 1 has an inner edge used to form the opening 12 of the cover ring 1. The inner edge of the cover ring 1 comprises two arc segments 18 and two straight segments 16. The two arc segments 18 and two straight segments 16 are connected, and it should be understood that one straight segment 16 connects two arc segments 18, and one arc segment 18 connects two straight segments 16. Exemplarily, two arc segments 18 are arranged oppositely, and two straight segments 16 are arranged oppositely. Exemplarily, the first magnetic part 5 such as first magnet 51 is adjacent to one of the two straight segments 16, and the rotating shaft 4 is adjacent to another one of the two straight segments 16. It should be noted that the inner edge of the cover ring 1 in the embodiments of the present application is not limited to this, and other structures may also be adopted, for example, the inner edge of the cover ring 1 is round, oval and the like. Another example is that the inner edge of the cover ring 1 comprises one straight segment and an arc segment, and it will not be listed all here.

Exemplarily, the first magnet 51 is embedded in the cover ring 1 to improve the installation stability of the first magnet 51 on the cover ring 1. It should be understood that the way in which the first magnet 51 is installed on the cover ring 1 is not limited to this.

Exemplarily, the first magnet 51 penetrates the cover ring 1 on one side of the cover ring 1 away from the cover body 2, so that the first magnet 51 is exposed on the side of the cover ring 1 away from the cover body 2. In some cases, the first magnet 51 is also capable of magnetic attraction with other components. For example, when the packaging cover 20*a* is applied to the outer container min body, the first magnet 51 can magnetically attract or separate from the magnetic parts on the outer container main body, or the first magnet 51 can magnetically attract or separate from the outer container main body of metal material. Whereby, in the embodiment of the application, the magnetic attraction of the first magnet 51 with the second magnetic part 6 on the cover body 2 can be realized, and the magnetic attraction of the first magnet 51 with the external container main body or with the magnetic parts on the external container main body can also be realized. The following is explained in conjunction with the schematic diagram of the packaging container.

In practical application, when the first magnet 51 and the outer container main body or the magnetic parts on the outer container main body are magnetically attracted, the connection stability is insufficient. In order to improve the connection stability between the packaging cover 20*a* and the external container main body, in an optional embodiment of the application, other detachable structures are further arranged on the cover ring 1.

Exemplarily, the first magnetic part 5 also includes at least one second magnet 52.

Exemplarily, the number of the second magnet 52 is at least two. The application takes the number of the second magnet 52 as two as an example, however it should be understood that the second magnet 52 can also be other numbers, and it will not be listed all here. Wherein, the second magnet 52 is exposed at least on the side of the cover ring 1 far away from the cover body 2, so that the second magnet 52 and the first magnet 51 are magnetically attracted together with the external container main body or the magnetic parts on the external container main body, so as to improve the connection stability between the packaging cover 20*a* and the outer container main body.

Exemplarily, two second magnets 52 are respectively arranged on two sides of the first magnets 51. Exemplarily, the spacings between the two second magnets 52 and the first magnets 51 are equal.

Exemplarily, the two second magnets 52 are respectively arranged on two sides of the rotating shaft 4, and it should be understood that the two second magnets 52 are respectively arranged on two sides of the shaft holes 14. Exemplarily, the spacings between the two second magnets 52 and the axes of the shaft hole 14 are equal.

Exemplarily, the spacings between the two second magnets 52 and the first magnet 51 are smaller than the spacings between the two second magnets 52 and the shaft holes 14. In other optional embodiments, the spacings between the two second magnets 52 and the first magnet 51 are greater than the spacings between the two second magnets 52 and the shaft holes 14.

Exemplarily, two second magnets 52 are embedded in the cover ring 1.

Exemplarily, the sides of the two second magnets 52 and the first magnet 51 away from the cover body 2 are exposed on the side of the cover ring 1 away from the cover body 2 and are flush, preventing the second magnet 52 and the first magnet 51 from protruding from the cover ring 1.

Exemplarily, the height of the first magnet 51 is greater than the height of the two second magnet 52. Wherein, the height of the first magnet 51 and the height of the second magnet 52 are the height in the thickness direction of the packaging cover 20*a*, or the height in the thickness direction of the cover ring 1. It should be understood that the opening 12 of the cover ring 1 penetrates through the cover ring 1 in the direction of the thickness of the cover ring 1. When the cover body 2 and the cover ring 1 fully coincide, the distance between the second magnet 52 and the cover body 2 is greater than the distance between the first magnet 51 and the cover body 2. It should be understood that the second magnet 52 is not used to magnetically attract each other with the second magnetic piece 6 on the cover body 2, so that the height of the two second magnets 52 being designed to be smaller than the height of the first magnet 51 can save materials to a certain extent, and reduce the weight of the packaging cover 20*a*.

Exemplarily, the first magnet 51 and the two second magnets 52 are roughly arranged in an isosceles triangle on the cover ring 1, and under the condition that the first magnet 51 and the two second magnets 52 are magnetically attracted together with the external container main body or the magnetic parts of the outer container main body, a three-point connection can be realized, and the connection stability between the packaging cover 20*a* and the outer container main body can be improved to a certain extent.

In order to improve the connection stability of the cover ring 1 and the rotating shaft 1, in the embodiments of the present application, a reinforcing column e is arranged on one side of the cover ring 1 close to the cover body 2. The cover ring 1 is provided with a mounting groove f for installing the first magnetic part 5, and the mounting groove f extends to the reinforcing column e, such as the mounting groove f penetrating through the reinforcing column e, and the first magnetic part 5 being installed in the mounting groove f. It should be understood that the first magnet 51 and the two second magnets 52 can be installed in the mounting groove f. It should be noted that there are three reinforcing columns e and three mounting grooves f in the cover ring 1 shown in FIG. 5, wherein two reinforcing columns and two mounting grooves are blocked and not shown, and a reinforcing column e and a mounting groove f shown in FIG. 5 can be referred for the specific structure.

It should be understood that the connection relationship between the packaging cover 20*a* and the external container main body in the embodiments of the present application is not limited to the detachable connection between the packaging cover 20*a* and the external container main body by means of magnetic attraction.

Exemplarily, a clamping structure can also be provided on the side of the cover ring 1 away from the cover body 2. Exemplarily, at least two clamping slots a are arranged on one side of the cover ring 1 away from the cover body 2. The embodiments of the present application take the two clamping slots a as an example to illustrate, and it should be understood that the number of clamping slots a is not limited to this. Clamping slot a can be clamped into the buckle part on the outer container main body.

Exemplarily, two clamping slots a are spaced apart from each other, for example, two clamping slots a are located between the rotating shaft 4 and the first magnet 51.

Exemplarily, the two clamp slots a are arranged opposite to each other.

Figure 7:
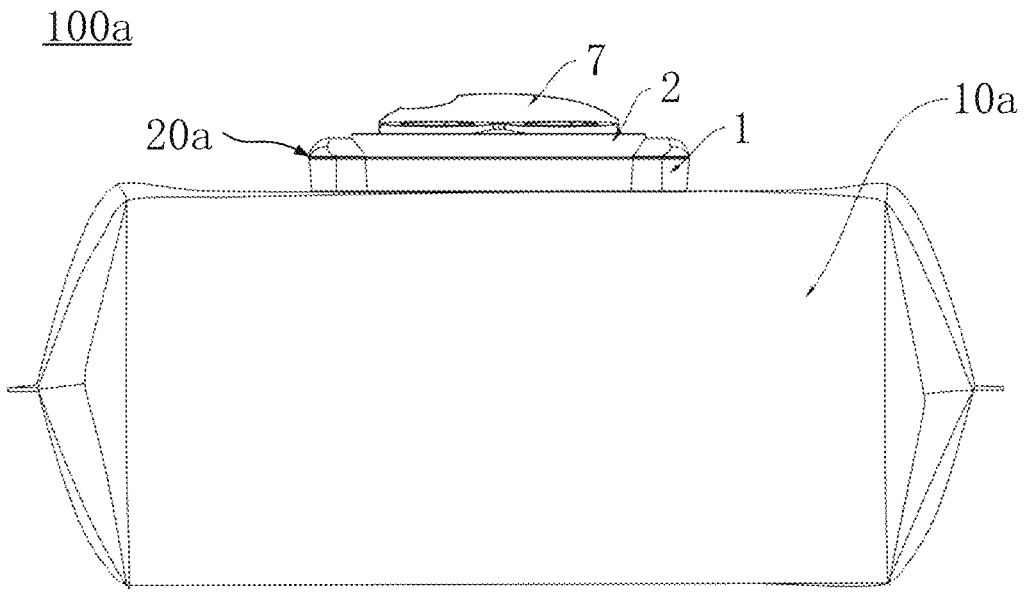
FIG. 7 is the structural diagram of a packaging container.
Figure 8:
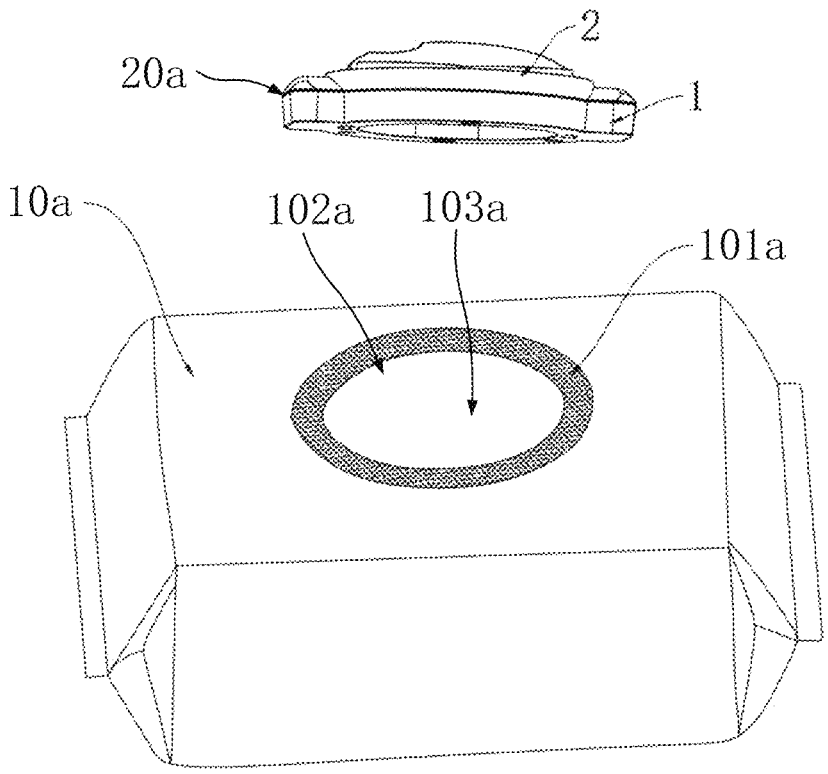
FIG. 8 is a schematic diagram of the separation state of the packaging cover and the container main body in the packaging container shown in FIG. 7.

Exemplarily, the shape of the two clamping slots a can be the same, e.g. Both in a shape of FIG. 7.

In other optional embodiments, at least two buckle parts are arranged on one side of the cover ring 1 away from the cover body 2. The buckle part on the cover ring 1 can be clamped into the clamping slot on the outer container main body.

In an optional embodiment of the application, a plugging structure may also be arranged on one side of the cover ring 1 away from the cover body 2. Exemplarily, at least two plugging columns are arranged on one side of the cover ring 1 far away from the cover body 2. The plugging columns on the cover ring 1 can be inserted into the plugging slots of the outer container main body, and the plugging columns on the cover ring 1 and the plugging slots of the outer container main body can be interference fitted.

Optionally, please continue to refer to FIG. 1, in which a decorative part 7 is protruded on the side of the cover body 2 away from the cover ring 1. The protruding decorative part 7 makes the top surface of the cover body 2 form an uneven surface, so that users can toggle the cover body 2 more easily and improve the aesthetics of the packaging cover. In the embodiment, the shape of the decorative part 7 can be designed according to actual needs, such as being in the shape of cartoon characters, cartoon pets, or plants. The embodiments of the present application do not limit the shape of the decorative part 7.

Figure 3:
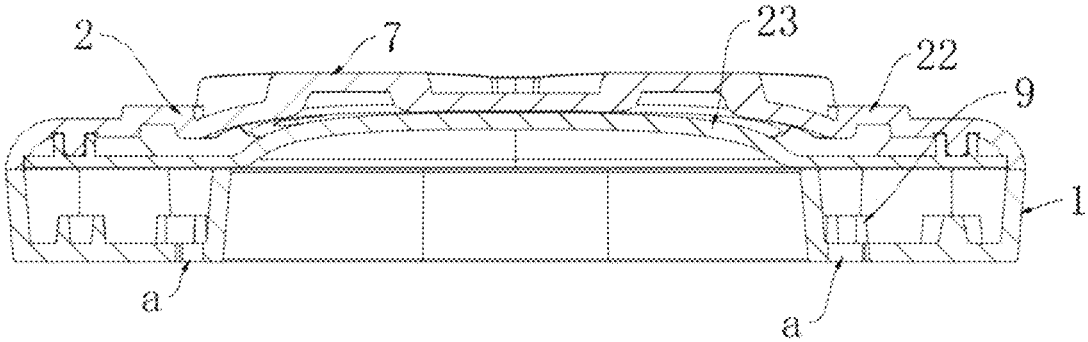
FIG. 3 is the section view of the packaging cover.
Figure 4:
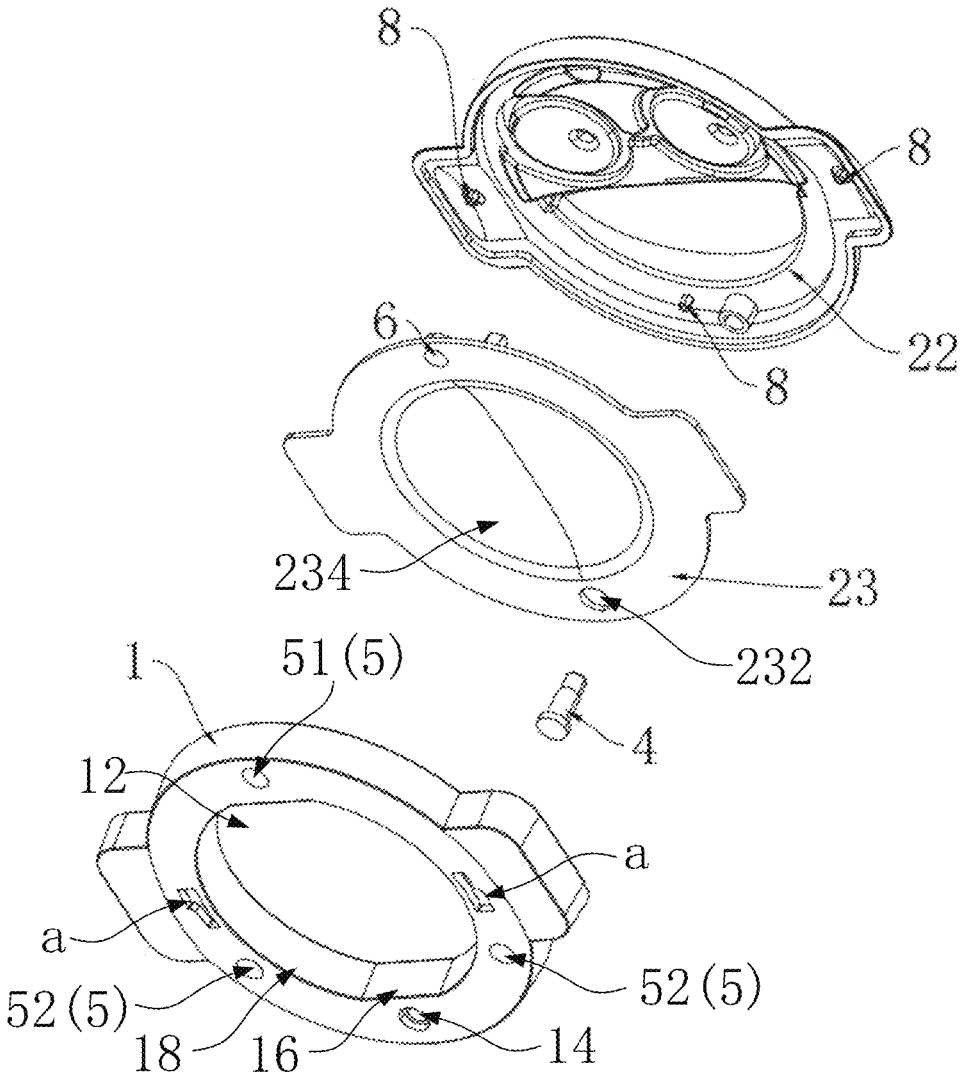
FIG. 4 is the explosive view of the packaging cover.
Figure 5:
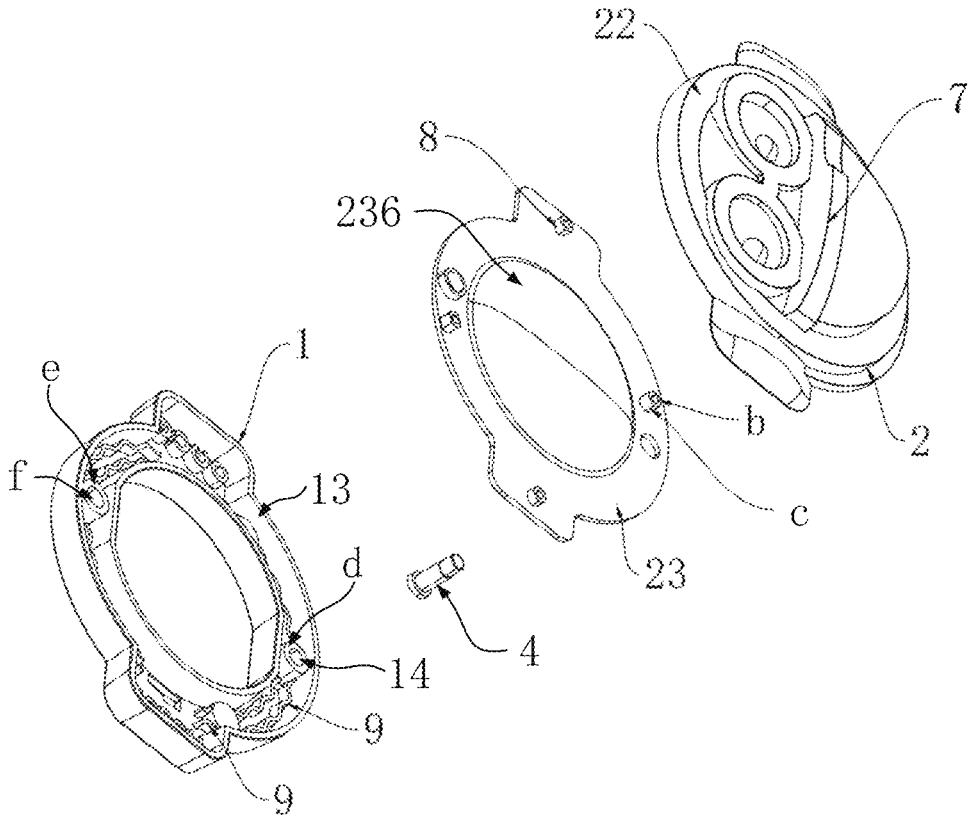
FIG. 5 is the explosive view of the packaging cover in another direction.

Optionally, as shown in FIGS. 3-5, the cover body 2 comprises a decorative cover 22 and a cover main body 23 arranged successively from top to bottom. The decorative part 7 is located on the top of the decorative cover 22. The cover main body 23 is used to cover the opening 12 of the cover ring 1. A plurality of plugging columns 8 are arranged at the bottom of the decorative cover 22. A plurality of plugging slots b fixed with the plugging columns 8 one by one in a plugging way are arranged at the top of the cover main body 23. In the embodiment, several reinforcing columns c protruding upwards from the top of the cover body 23, and the plugging slots b are disposed on the reinforcing column c. The plugging column 8 is in an interference fit with the plugging slot b.

Exemplarily, the decorative cover 22, the cover body 23 and the cover ring 1 are made of plastic or alloy or wood. In the embodiment, the decorative cover 22, the cover body 23 and the cover ring 1 are made of plastic.

In order to reduce the material waste of the cover ring 1 and ensure the strength of the cover ring 1 meanwhile, an annular groove 13 is arranged at the top of the cover ring 1 outside the hole of the cover ring 1, and a plurality of reinforcing ribs 9 are arranged at the bottom of the annular groove. Exemplarily, at least one reinforcing rib 9 is connected to the reinforcing column d, and at least one reinforcing rib 9 is connected to the reinforcing column e. The strength of reinforced column d and reinforced column e can be improved.

Exemplarily, at least one reinforcing rib 9 is shaped as letters for a specific brand entity to achieve brand association.

In the present embodiment, the rotating shaft 4 is connected to the cover ring 1, the cover body 23, and the decorative cover 22 In other optional embodiments, the rotating shaft 4 is connected to the cover ring 1 and the cover body 23, but not to the decorative cover 22.

Figure 6:
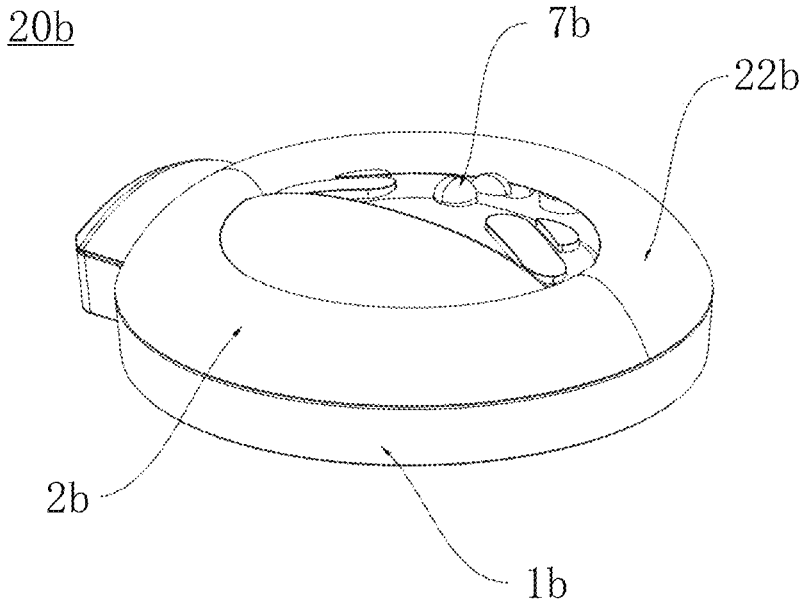
FIG. 6 is the structural diagram of the decorative part for the packaging cover in another proposal.

As shown in FIG. 6, the difference between the packaging cover 20*b* shown in FIG. 6 and the packaging cover 20*a* shown in FIGS. 1 to 5 at least includes that the shape of the decorative part 7*b* of the packaging cover 20*b* is different from the shape of the decorative part 7. Exemplarily, the shape of the cover body 2*b* of the packaging cover 20*b* is different from the shape of the cover body 2. Exemplarily, the appearance of the decorative cover 22*b* of the packaging cover 20*b* is different from that of the decorative cover 22.

The difference between the packaging cover 20*b* shown in FIG. 6 and the packaging cover 20*a* shown in FIG. 1 to 5 at least includes that the shape of the cover ring 1*b* is different from that of the cover ring 1.

Wherein, the external container main body can be a component with an opening. For example, the external container main body is a bag body, a package body, or a cup body.

Exemplarily, the external container main body can store tissues, such as wet tissues. In following, combined with the schematic diagram of the packaging container, the relationship between the packaging cover and the external container main body is described.

As shown in FIGS. 7 to 10, combined with FIGS. 1 to 5, the present embodiment also provides a packaging container 100*a*, which includes a container main body 10*a* and a packaging cover 20*a*. Wherein the packaging cover 20*a* can be referred to as shown in FIGS. 1 to 5, including a cover ring 1, a cover body 2 and the like, and will not be further elaborated here Wherein, the container main body 10*a* has a storage space 103*a* and an opening 102*a* communicates with the storage space 103*a*, with the opening 102*a* located at the top of the container main body 10*a*. The storage space 103*a* can store items such as wet tissues, and items stored in the storage space 103*a* can be taken out from the opening 102*a*.

Exemplarily, the top of the container main body 10*a* is provided with a detachable connection structure, which can be detachably connected to the side of the cover ring 1 away from the cover body 2.

Wherein, the cover ring 1 and the container main body 10*a* are detachably connected. When the cover ring 1 is connected to the container main body 10*a*, the opening 12 of the cover ring 1 communicates with and corresponds to the opening 102*a* of the container main body 10*a*. It should be understood that the size of the opening 12 of the cover ring 1 and the opening 102*a* of the container main body 10*a* are roughly matched. Cover body 2 simultaneously closes the opening 12 of cover ring 1 and the opening 102*a* of container main body 10*a*.

Wherein, the detachable connection methods of the cover ring 1 and the container main body 10*a* include but are not limited to achieving detachable connection through bonding, detachable connection through clamping, and detachable connection through magnetic attraction. Exemplarily, the container main body 10*a* is provided with an adhesive film 101*a* on its top surface, which is arranged in a circle around the opening 102*a* of the container main body 10*a*. That is, the detachable connection structure disposed at the top of the container main body 10*a* is the adhesive film 101*a*. The adhesive film 101*a* can bond with the side of the cover ring 1 away from the cover body 2 to achieve the connection between the cover ring 1 and the container main body 10*a*. It should be understood that the cover ring 1 can also be separated from the adhesive film 101*a*.

Figure 9:
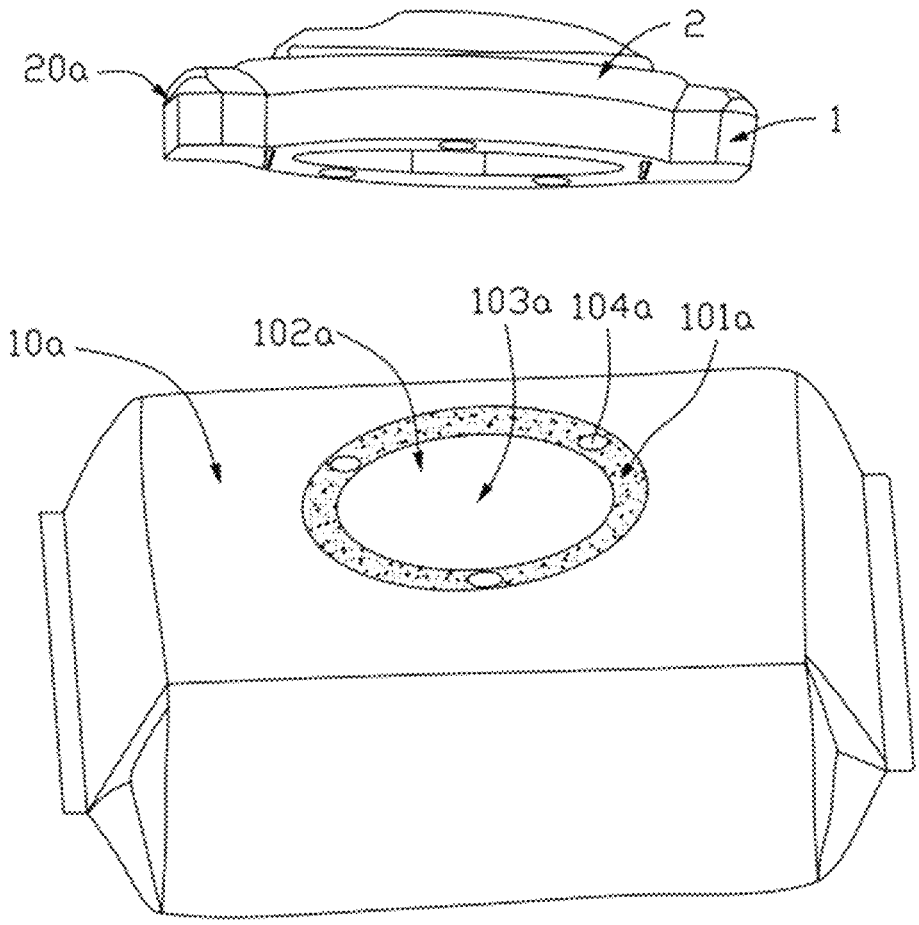
FIG. 9 is a schematic diagram of another separation state of the packaging cover and the container main body in the packaging container shown in FIG. 7.

Please refer to FIG. 9 together. Exemplarily, the adhesive film 101*a* is provided with a plurality of vias/openings 104*a* distributed at intervals, and the vias or openings 104*a* are used for avoiding functional devices on the surface of the cover ring 1 away from the cover body 2. It can be understood that due to the exposed first magnetic part 5 and second magnetic part 6 on the surface of the cover ring 1 away from the cover body 2, the vias/openings 104*a* can be arranged corresponding to the positions of the first magnetic part 5 and the second magnetic part 6. Therefore, while connecting the cover ring 1 and the container main body 10*a* through adhesion, it is ensured that the first magnetic part 5 and the second magnetic part 6 are further magnetically connected to the container main body 10*a*, which further enhancing the stability of the connection between the packaging cover 20*a* and the container main body 10*a*.

Exemplarily, the functional device may include a first magnetic part 5. It should be understood that the functional devices are not limited to the first magnetic part 5, they can also be other devices such as buckle structure, column structure, etc. disposed on the surface of the cover ring 1 away from the cover body 2.

It can be understood that when multiple 104*a* are opened on the adhesive film 101*a*, the adhesive film 101*a* is divided into multiple arc segments spaced apart, that is, the overall arrangement of the adhesive film 101*a* is a circular structure. The shape of the adhesive film 101*a* is compatible with the shape of the opening 12 of the cover ring 1, for example, it can be circular, square, triangle, etc., without limitation here.

Figure 10:
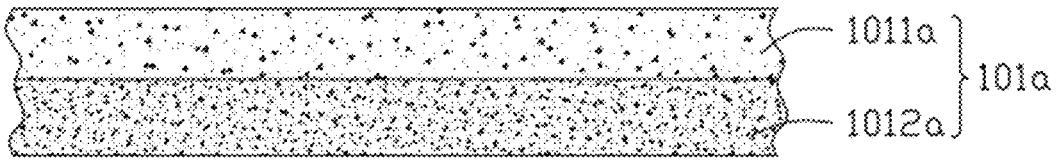
FIG. 10 is the structural diagram of the adhesive film in the packaging container shown in FIG. 7.

Please refer to FIG. 10. Exemplarily, the adhesive film 101*a* is different from a regular single-layer adhesive film, as it has a multi-layer structure. The adhesive film 101*a* comprises a first adhesive layer 1011*a* and a second adhesive layer 1012*a* which are laminated. In this embodiment, the first adhesive layer 1011*a* and the second adhesive layer 1012*a* are made of the same material. It can be understood that the first adhesive layer 1011*a* and the second adhesive layer 1012*a* can also be made of different materials. Wherein, the first adhesive layer 1011*a* is bonded to one side of the cover ring 1 away from the cover body 2, and the second adhesive layer 1012*a* is bonded to the surface of the container main body 10*a*. Compared to the single-layer adhesive layer structure connecting the cover ring 1 and the container main body 10*a*, the first adhesive layer 1011*a* and the second adhesive layer 1012*a* of the adhesive film 101*a* in this application can improve the stability of the connection between the cover ring 1 and the container main body 10*a*.

Exemplarily, the thickness of the first adhesive layer 1011*a* is greater than that of the second adhesive layer 1012*a*. This ensures that, on the one hand, the first adhesive layer 1011*a* of the adhesive film 101*a* can firmly adhere to the cover ring 1, and on the other hand, it can ensure that when the second adhesive layer 1012*a* of the adhesive film 101*a* is adhered to the surface of the container main body 10*a*, it is easier to peel off the protective paper on the surface of the adhesive film 1012*a* to prevent damage to the structure of the second adhesive layer 1012*a* when peeling off the protective paper. It should be understood that in the process of separating the surface of the second adhesive layer 1012*a* from the container main body 10*a*, in order to avoid the separation of the first adhesive layer 101*a* and the cover ring 1, the thickness of the first adhesive layer 1011*a* is set to be greater than the thickness of the second adhesive layer 1012*a*.

It should be noted that in other optional embodiments, the positions of the first adhesive layer 1011*a* and the second adhesive layer 1012*a* can be interchanged to facilitate the separation of the first adhesive layer 1011*a* from the cover ring 1.

Figure 11:
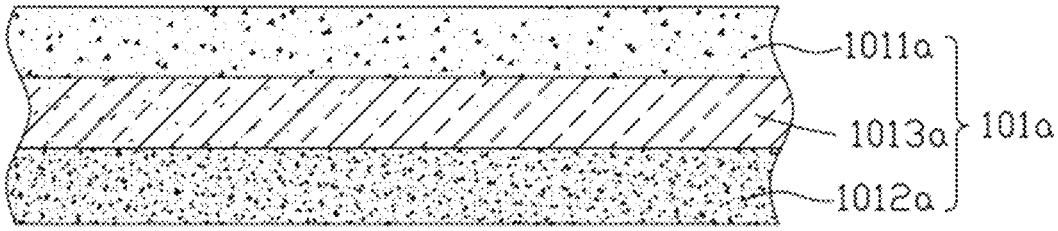
FIG. 11 is another the structural diagram of the adhesive film in the packaging container shown in FIG. 7.

Please refer to FIG. 11. Exemplarily, the adhesive film 101*a* further comprises an interlayer 1013*a* arranged between the first adhesive layer 1011*a* and the second adhesive layer 1012*a*. Wherein, the interlayer 1013*a* is made of plastic material. In this embodiment, the interlayer 1013*a* is made of polyethylene terephthalate plastic, PET. Exemplarily, the material of the interlayer 1013*a* is different from that of the first adhesive layer 1011*a* and the second adhesive layer 1012*a*. The interlayer 1013*a* serves as a carrier and is coated with adhesive on its upper and lower surfaces to form the first adhesive layer 1011*a* and the second adhesive layer 1012*a*. Wherein, the interlayer 1013*a* is made of transparent material. Exemplarily, the interlayer 1013*a* can completely separate the first adhesive layer 1011*a* and the second adhesive layer 1012*a*, facilitating the separation of one of the two from the bonded structure.

During use, the user can open or close the opening 12 of the cover ring 1 and the opening 102*a* of the container main body 10*a* by toggling the cover body 2 to rotate the cover body 2 horizontally relative to the cover ring 1 by means of rotating shaft 4. When the opening 12 of the cover ring 1 is open, the user can fill the container main body 10*a* with items or take the items from the container main body 10*a*. When the cover ring 1 and the cover body 2 coincide, the opening 102*a* of the container main body 10*a* can be closed to prevent contaminants such as external dust from entering the container main body 10*a* and contaminating the items inside the container main body 10*a*.

Exemplarily, the container main body 10*a* can be a plastic bag. It should be understood that the material of container main body 10*a* is not limited to plastic, such as metal materials can also be used.

Exemplarily, the container main body 10*a* can undergo deformation.

In some embodiments, the container main body 10*a* is polygonal, and in some embodiments, the container main body 10*a* is barrel shaped.

Exemplarily, when the cover body 2 completely coincides with the cover ring 1, the cover body 2 closes the opening 12 of the cover ring 1 and the opening 102*a* of the container main body 10*a*, and the outer edge of the cover body 2 and the outer edge of the cover ring 1 do not protrude from the outer edge of the container main body 10*a*.

It should be noted that the packaging cover 20*a* in packaging container 100*a* can also be replaced with the packaging cover 20*b*, and it will not be listed all here.

Figure 12:
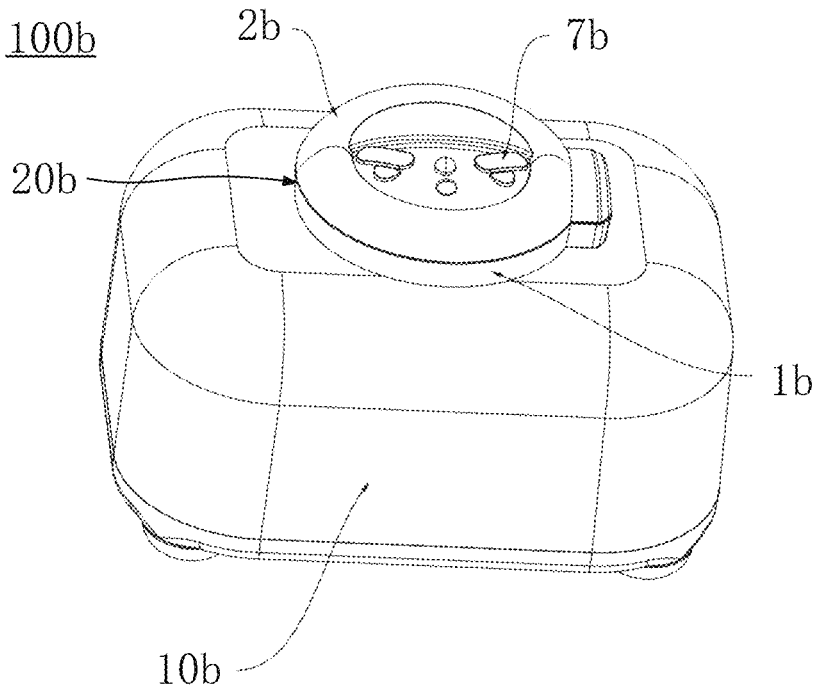
FIG. 12 is the structural diagram of another packaging container.
Figure 13:
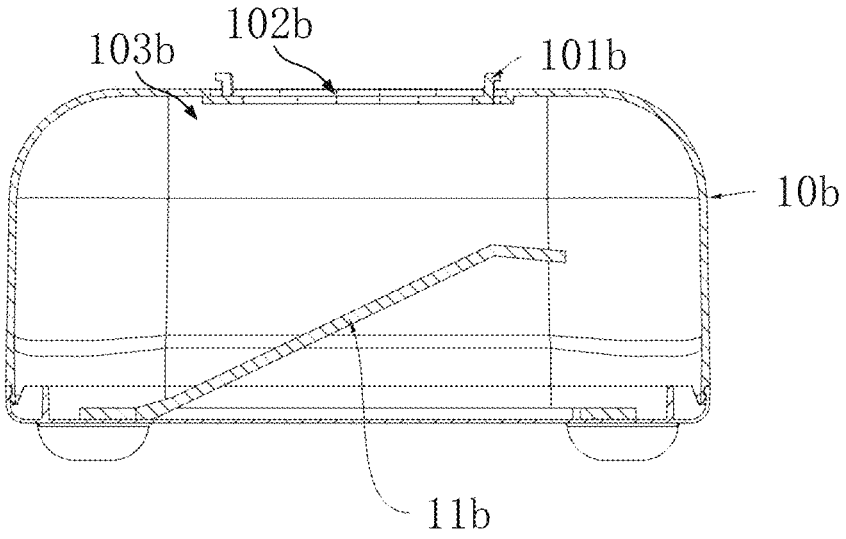
FIG. 13 is the section view of the packaging main body of the packaging container shown in FIG. 12.

As shown in FIGS. 12 and 13, combined with FIGS. 1 to 11, the present embodiment also provides a packaging container 100*b*, which includes a container main body 10*b* and a packaging cover 20*b*. Wherein the packaging cover 20*b* can be referred to as shown in FIG. 6, and including a cover ring 1, a cover body 2 and the like, and will not be further elaborated here. It should be noted that the other structures arranged on the cover ring 1*b* and the other structures arranged on the cover body 2*b*, such as the rotating shaft, the first magnetic part, and the clamping slot, can be referred to in FIG. 1 to 5, such as the rotating shaft 4, the first magnetic part 5, and the clamping slot b, and will not be further elaborated here Wherein, the container main body 10*b* has a storage space 103*b* and an opening 102*b* communicates with the storage space 103*b*, with the opening 102*b* located at the top of the container main body 10*b*. The storage space 103*b* can store items such as wet tissues, and items stored in the storage space 103*b* can be taken out from the opening 102*b*.

Exemplarily, the top of the container main body 10*b* is provided with a detachable connection structure, which can be detachably connected to the side of the cover ring 1*b* away from the cover body 2*b*. Exemplarily, the container main body 10*b* is provided with at least two buckle parts 101*b* on its top surface, and at least two buckle parts 101*b* are spaced around the opening 102*b* of the container main body 10*b*, or at least two buckle parts 101*b* are protruded outward at the edge of the opening 102*b* of the container main body 10*b*. That is, the detachable connection structure disposed at the top of the container main body 10 is at least two buckle parts 101*b*.

At least two buckle parts 101*b* are disposed with protrusions at the edges of the opening 102*b* of the container main body 10*b*. The buckle part 101*b* can be inserted into the clamping slot a to achieve the connection between the buckle part 101*b* and the clamping slot a, thereby connecting the cover ring 1*b* and the container main body 10*b*. The buckle part 101*b* can be removed from the clamping slot a, achieving the separation of the cover ring 1*b* and the container main body 10*b*.

Exemplarily, the number of clamping slots a is the same as the number of clamping parts 101*b*, and the arrangement of clamping slots can increase the application scenarios of packaging cover 20*a*.

Exemplarily, the buckle part 101*b* is in a shape of FIG. 7, and the clamping slot a is in a shape of FIG. 7.

For example, the container main body 10*b* can be a container for holding tissues. The edge of the opening 102*b* of the container main body 10*b* is provided with a buckle part 101*b*. The clamping slot a on the packaging cover 20*b* can be aligned with the buckle part 101*b* one by one. Then, the packaging cover 20*b* can be pressed down to insert the buckle part 101*b* into the clamping slot a and rotate the cover ring 1*b*, and then rotate the cover ring 1*b* so that the buckle part 101*b* is stuck with the cover ring 1*b*, avoiding the packaging cover 20*b* from detaching from the container main body 10*b* upwards. Thus the assembly of packaging container 100*b* is completed.

In this embodiment, an elastic member 11*b* is provided inside the container main body 10*b* for abutting the tissue inside to one side of the opening 102*b* of the container main body 10*b*. The elastic member 11*b* can be a spring or multiple springs connected at one end to the bottom of the container main body 10*b*.

In some embodiments, the container main body 10*b* is polygonal, and in some embodiments, the container main body 10*b* is barrel shaped.

For example, the container main body 10*b* can be a plastic box. It should be understood that the material of container main body 10*b* is not limited to plastic, such as metal materials can also be used.

Exemplarily, the container main body 10*b* is not deformable.

It should be noted that the packaging cover 20*b* in the packaging container 100*b* can also be replaced with the packaging cover 20*a*, and it will not be listed all here.

In other optional embodiments, the container main body of the packaging container is a metal product that can be magnetically attracted by the first magnetic component 5, making the assembly between the packaging cover 20*a* or packaging cover 20*b* and the container main body faster. The container main body with metal material can be referred to in FIGS. 7 to 10, and will not be further elaborated here. It should be understood that in this embodiment, the first magnetic part 5, such as the first magnet 51 and the second magnet 52, all have magnetism.

In other optional embodiments, the container main body of the packaging container is provided with a third magnetic part on its top surface, which can be arranged around the opening of the container main body. For example, multiple third magnetic parts are arranged on the container main body, and multiple third magnetic parts are spaced around the opening of the container main body. Exemplarily, the number of multiple third magnetic parts set on the container main body is the same as the sum of the first magnet 51 and the second magnet 52. Multiple third magnetic parts arranged on the container main body can be magnetically attracted to all first magnets 51 and second magnets 52, achieving the connection between the packaging cover 20*a* or packaging cover 20*b* and the container main body. It should be understood that multiple third magnetic parts arranged on the container main body can be separated from all first magnets 51 and second magnets 52, achieving the separation of the packaging cover 20*a* or packaging cover 20*b* from the container main body.

In practical using, the bottom of the cover ring 1 can be placed at the opening of the container main body, so that the first magnet 51 and the second magnet 52 are magnetically fixed with the third magnetic component at the edge of the opening of the container main body, thereby achieving the installation of the packaging cover 20*a* or packaging cover 20*b* onto the container main body and achieving rapid installation of the packaging cover 20*a* or packaging cover 20*b* with the container main body.

Wherein, the third magnetic part is a magnet or metal block that can be magnetically attracted to the first magnet 51 and the second magnet 52. Exemplarily, the third magnetic part is a metal block, and the first magnet 51 and the second magnet 52 are both magnets.

The above is only used to describe the technical proposal of the utility model and not to limit it, and other modifications or equivalent replacements made by the ordinary technicians in the field to the technical proposal of the utility model should be covered in the scope according to claims of the utility model as long as they do not deviate from the spirit and scope of the technical proposal of the utility model.

What is claimed is:

1. A packaging container, comprising: a container main body (10*a*, 10*b*) which is provided with an opening (102*a*);

a packaging cover (20*a*, 20*b*) which comprises a cover ring (1) having an opening (12) and a cover body (2) covering the opening (12); where in the cover ring (1) and the container main body (10*a*, 10*b*) are detachably connected, the opening (102*a*) of the cover ring (1) is communicated with the opening (12) of the container main body (10*a*, 10*b*), and the cover body (2) can open or close the opening (12) of the cover ring (1) and the opening (102*a*) of the container main body (10*a*, 10*b*) under operations of a user;

wherein the detachable connection of the cover ring (1) and the container main body (10*a*, 10*b*) is constructed so that at least one of:

A) the cover ring (1) and the container main body (10*a*, 10*b*) are detachably connected by bonding;

B) the cover ring (1) and the container main body (10*a*, 10*b*) are detachably connected by clamping; or C) the cover ring (1) and the container main body (10*a*, 10*b*) are detachably connected by magnetic attraction;

wherein the container main body (10*a*, 10*b*) comprises an adhesive film (101*a*) which surrounds the opening (102*a*) of the container main body (102*a*), and the adhesive film (101*a*) is bonded to a surface of the cover ring (1) away from the cover body (2) to realize the connection of the cover ring (1) and the container main body (10*a*);

wherein a first magnetic part is on the surface of the cover ring (1) away from the cover body (2);

wherein the adhesive film (101*a*) is provided with a plurality of vias or openings (104*a*) distributed at intervals, and the vias or openings (104*a*) are used for avoiding the first magnetic part.

2. The packaging container according to claim 1, wherein the adhesive film (101*a*) comprises a first adhesive layer (1011*a*) and a second adhesive layer (1012*a*) that are laminated, and a thickness of the first adhesive layer (1011*a*) is greater than that of the second adhesive layer (1012*a*).

3. The packaging container according to claim 2, wherein the adhesive film (101*a*) further comprises an interlayer (1013*a*) arranged between the first adhesive layer (1011*a*)

and the second adhesive layer (1012*a*), and material of the interlayer (1013*a*) is different from that of the first adhesive layer (1011*a*) and the second adhesive layer (1012*a*).

4. The packaging container according to claim 1, wherein the cover body (2) is rotatably installed on the cover ring (1), the packaging cover further comprises a second magnetic part (6) arranged on the cover body (2), and the first magnetic part (5) and the second magnetic part (6) can be attracted or separated to open or close the opening (12).

5. The packaging container according to claim 4, wherein the cover body (2) is rotatably assembled on the cover ring (1) through a rotating shaft (4), and the first magnetic part (5) and the rotating shaft (4) are spaced apart and arranged oppositely with respect to the opening (12).

6. The packaging container according to claim 4, wherein the first magnetic part (5) comprises a first magnet (51) and at least one second magnet (52), the second magnetic part (6) is one in number, and, the second magnetic part (6) and the first magnet (51) coincide.

7. The packaging container according to claim 6, wherein a height of the first magnet (51) is greater than that of the second magnet (52), when the cover body (2) is completely overlapped with the cover ring (1), a distance between the second magnet (52) and the cover body (2) is greater than that between the first magnet (51) and the cover body (2).

8. The packaging container according to claim 1, wherein clamping slots (a) are spaced apart on one side of the cover ring (1) away from the cover body (2), buckle parts (101*b*) are arranged at an edge of the opening (102*b*) of the container main body (10*b*), and the buckle parts (101*b*) are inserted into the clamping slot (a) to connect the container main body (10*b*) and the packaging cover (20*b*) with buckle.

9. The packaging cover according to claim 1, wherein a decorative part (7) is protruded on one side of the cover body (2) away from the cover ring (1); the cover body (2) comprises a decorative cover (22) and a cover main body (23) arranged successively from top to bottom, the decorative part (7) is located on the top of the decorative cover (22), the cover main body (23) is used to cover the opening (12), a plurality of plugging columns (8) are arranged at the bottom of the decorative cover (22), and a plurality of plugging slots (b) fixed with the plugging columns (8) one by one in a plugging way are arranged at the top of the cover main body (23).

10. A packaging cover, comprises a cover ring (1) having an opening (12) and a cover body covering the opening (12), wherein the cover body (2) can open or close the opening (12) under operations of a user;

the packaging cover further comprises a first magnetic part (5) arranged on the cover ring (1) and a second magnetic part (6) arranged on the cover body (2), and the first magnetic part (5) and the second magnetic part (6) can be attracted or separated to open or close the opening (12);

wherein the cover body (2) is rotatably assembled on the cover ring (1) through a rotating shaft (4), and the first magnetic part (5) and the rotating shaft (4) are spaced apart and arranged oppositely with respect to the opening (12).

11. The packaging cover according to claim 10, wherein the first magnetic part (5) comprises a first magnet (51) and at least one second magnet (52), the second magnetic part (6) is one in number, and when the cover body (2) and the cover ring (1) fully coincide, the second magnetic part (6) and the first magnet (51) coincide.

12. The packaging cover according to claim 11, wherein the at least one second magnet (52) is two in number, the two second magnets (52) are respectively arranged on two sides of the first magnet (51) and the spacing between the two second magnets (52) and the first magnet (51) is equal; the first magnet (51) and the second magnet (52) are embedded in the cover ring (1), and one side of the first magnet (51) and one side the second magnet (52) away from the cover body (2) are exposed from and flush with one side of the cover ring (1) away from the cover body (2).

13. The packaging cover according to claim 11, wherein a height of the first magnet (51) is greater than that of the second magnet (52), when the cover body (2) and the cover ring (1) fully coincide, a distance between the second magnet (52) and the cover body (2) is greater than that between the first magnet (51) and the cover body (2).

14. The packaging cover according to claim 10, wherein at least two clamping slots (a) are spaced apart on one side of the cover ring (1) away from the cover body (2).

15. A packaging cover, comprises a cover ring (1) having an opening (12) and a cover body covering the opening (12), wherein the cover body (2) can open or close the opening (12) under operations of a user;

the packaging cover further comprises a first magnetic part (5) arranged on the cover ring (1) and a second magnetic part (6) arranged on the cover body (2), and the first magnetic part (5) and the second magnetic part (6) can be attracted or separated to open or close the opening (12);

a decorative part (7) is protruded on one side of the cover body (2) away from the cover ring (1);

the cover body (2) comprises a decorative cover (22) and a cover main body (23) arranged successively from top to bottom, the decorative part (7) is located on the top of the decorative cover (22), the cover main body (23) is used to cover the opening, and a plurality of plugging columns (8) are arranged at the bottom of the decorative cover (22), and a plurality of plugging slots (b) fixed with the plugging columns (8) one by one in a plugging way are arranged at the top of the cover main body (23).

* * * * *